US008439651B2

(12) United States Patent
Gilpatrick

(10) Patent No.: US 8,439,651 B2
(45) Date of Patent: May 14, 2013

(54) GARDEN HOSE BOOSTER WATER PUMP SYSTEM

(75) Inventor: Richard J. Gilpatrick, Whitewater, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 317 days.

(21) Appl. No.: 12/502,798

(22) Filed: Jul. 14, 2009

(65) Prior Publication Data

US 2011/0014066 A1 Jan. 20, 2011

(51) Int. Cl.
*F04B 53/00* (2006.01)

(52) U.S. Cl.
USPC ..... 417/234; 137/355.12; 137/355.26

(58) Field of Classification Search ..... 417/234; 137/355.12, 899.3, 355.2, 355.26
See application file for complete search history.

(56) References Cited

U.S. PATENT DOCUMENTS

| | | | | |
|---|---|---|---|---|
| 828,705 | A | | 8/1906 | Bode |
| 1,262,539 | A | | 4/1918 | Micka |
| 1,369,567 | A | | 2/1921 | Smith |
| 2,678,457 | A | | 1/1950 | Demo et al. |
| 2,540,240 | A | | 2/1951 | Boyle |
| 3,030,890 | A | | 4/1962 | Galik |
| 3,114,164 | A | | 12/1963 | Riordan |
| 3,283,352 | A | | 11/1966 | Hu |
| 3,383,044 | A | | 5/1968 | Norstrud et al. |
| 3,748,678 | A | | 7/1973 | Ballou |
| 3,931,830 | A | * | 1/1976 | Gritz ..... 137/505.45 |
| 4,084,281 | A | | 4/1978 | Smith |
| 4,089,079 | A | | 5/1978 | Nicholson |
| 4,135,860 | A | | 1/1979 | van Nederkassel |
| 4,207,640 | A | | 6/1980 | Sekula et al. |
| 4,227,862 | A | | 10/1980 | Andrew et al. |
| 4,238,074 | A | * | 12/1980 | Coons ..... 239/745 |
| 4,249,282 | A | * | 2/1981 | Little ..... 16/32 |
| 4,290,735 | A | * | 9/1981 | Sulko ..... 417/2 |
| 4,373,444 | A | | 2/1983 | Cunnington |
| 4,387,850 | A | | 6/1983 | Gerber |
| 4,417,826 | A | | 11/1983 | Floros |
| 4,461,052 | A | | 7/1984 | Mostul |
| 4,507,053 | A | | 3/1985 | Frizzell |
| 4,513,466 | A | | 4/1985 | Keddie et al. |
| 4,532,666 | A | | 8/1985 | Smyth |
| 4,618,100 | A | * | 10/1986 | White et al. ..... 239/440 |
| 4,763,373 | A | | 8/1988 | Sanchez |

(Continued)

OTHER PUBLICATIONS

U.S. Appl. No. 12/411,139, filed Mar. 25, 2009, Gilpatrick.

(Continued)

*Primary Examiner* — Charles Freay
*Assistant Examiner* — Thomas Fink
(74) *Attorney, Agent, or Firm* — Foley & Lardner LLP

(57) ABSTRACT

A booster pump system, for boosting a flow of water from a water source, includes a housing having a retractable handle. The booster pump system also includes a water pump positioned within the housing. The pump has an inlet and an outlet, and is designed to raise the pressure of the flow of water by an amount in a range of 20-200 pounds per square inch. The pump is also designed to raise the flow rate of the flow of water by an amount in a range of 0.5-5 gallons per minute. The booster pump system further includes a hose reel positioned within the housing, where the hose reel supports a garden hose attached to the outlet of the pump.

19 Claims, 5 Drawing Sheets

U.S. PATENT DOCUMENTS

| | | | | |
|---|---|---|---|---|
| 4,856,133 | A | 8/1989 | Sanchez | |
| 5,007,127 | A | 4/1991 | Paolo | |
| 5,029,758 | A * | 7/1991 | Chayer | 239/172 |
| 5,129,121 | A | 7/1992 | Gelman | |
| 5,259,733 | A * | 11/1993 | Gigliotti et al. | 417/38 |
| 5,395,052 | A | 3/1995 | Schneider et al. | |
| 5,421,520 | A | 6/1995 | Simonette et al. | |
| 5,529,460 | A | 6/1996 | Eihusen et al. | |
| 5,619,766 | A | 4/1997 | Zhadanov et al. | |
| 5,649,334 | A | 7/1997 | Henriquez et al. | |
| 5,741,124 | A | 4/1998 | Mazzucato et al. | |
| 5,911,256 | A | 6/1999 | Tsai | |
| 5,913,982 | A | 6/1999 | Phillips | |
| 5,975,423 | A * | 11/1999 | Rice et al. | 239/1 |
| 6,021,539 | A | 2/2000 | Zhadanov et al. | |
| 6,164,496 | A | 12/2000 | Gregory | |
| 6,189,811 | B1 * | 2/2001 | Rudy | 239/375 |
| 6,561,481 | B1 | 5/2003 | Filonczuk | |
| 6,571,805 | B2 | 6/2003 | Hoenisch et al. | |
| 6,687,924 | B2 | 2/2004 | Wright et al. | |
| 6,688,855 | B2 | 2/2004 | Beckerman | |
| 6,913,221 | B2 * | 7/2005 | Moon et al. | 242/390.8 |
| 6,915,541 | B2 | 7/2005 | Alexander | |
| 6,921,060 | B2 * | 7/2005 | Weed, Jr. | 254/266 |
| 7,017,603 | B1 * | 3/2006 | Rosine et al. | 137/355.12 |
| 7,080,953 | B2 | 7/2006 | DeLaine, Jr. | |
| 7,083,120 | B2 | 8/2006 | Gilpatrick et al. | |
| 7,217,053 | B2 | 5/2007 | Alexander et al. | |
| 7,222,644 | B2 | 5/2007 | Pianetto et al. | |
| 7,281,903 | B2 | 10/2007 | Reverberi et al. | |
| 7,316,368 | B2 * | 1/2008 | Moon et al. | 242/390.9 |
| 7,472,842 | B2 | 1/2009 | Gilpatrick et al. | |
| 7,762,787 | B2 | 7/2010 | Kawakami et al. | |
| 2004/0231723 | A1 | 11/2004 | Harrington et al. | |
| 2005/0013708 | A1 | 1/2005 | Peeler et al. | |
| 2005/0017117 | A1 * | 1/2005 | Moon et al. | 242/390.8 |
| 2005/0161538 | A1 | 7/2005 | Cattaneo et al. | |
| 2005/0164554 | A1 | 7/2005 | Cattaneo et al. | |
| 2006/0083634 | A1 | 4/2006 | Dexter et al. | |
| 2006/0245941 | A1 | 11/2006 | Sharp | |
| 2007/0113368 | A1 | 5/2007 | Alexander | |
| 2007/0114319 | A1 * | 5/2007 | Anderson et al. | 242/395 |
| 2007/0125878 | A1 | 6/2007 | Hahn et al. | |
| 2008/0014096 | A1 | 1/2008 | Gilpatrick | |
| 2008/0050246 | A1 * | 2/2008 | Bevington | 417/1 |
| 2008/0083077 | A1 | 4/2008 | Alexander et al. | |
| 2008/0245425 | A1 | 10/2008 | Alexander | |
| 2008/0300727 | A1 | 12/2008 | Zarowny et al. | |
| 2009/0269218 | A1 | 10/2009 | Gardner et al. | |

OTHER PUBLICATIONS

Energy Tips—Pumping Systems, Pumping Systems Tip Sheet #12, Control Strategies for Centrifugal Pumps with Variable Flow Rate Requirements, U.S. Department of Energy, dated May 2007, 2 pages.

Garden Hose Centrifugal Pump I BIC Superstore, Flint Walling/Star HPP360 Garden Hose Centrifugal Pump, printed on Jan. 6, 2009, from Internet address: http://www.bicsuperstore.com/Garden-Hose-Centrifugal-Pump/M/B000DZKZ02.htm, 3 pages.

Gauges, Water Pumps, and Flow Meters from Premium Water Filters, Premium Water Filters, printed on Jan. 6, 2009, from Internet address: http://www.premium-water-filters.com/gauges-pumps.htm, 12 pages.

Garden Hose Comfort Grip Nozzle 7 Pattern #594 by Gilmour Manufacturing at HardwareandTools.com, Garden Hose Nozzles Zinc "Select-A-Spray", printed on Jan. 6, 2009, from Internet address: http://www.hardwareandtools.com/invt/3774379, 4 pages.

Invitation to Pay Additional Fees and Partial International Search Report for International Application No. PCT/US2010/028157, mail date Jun. 10, 2011, 10 pages.

International Search Report and Written Opinion for Application No. PCT/US2010/028157, mail date Aug. 31, 2011, 23 pages.

Office Action for U.S. Appl. No. 12/411,139, mail date Aug. 3, 2011, 15 pages.

* cited by examiner

GARDEN HOSE BOOSTER WATER PUMP SYSTEM

BACKGROUND

The present invention relates generally to the field of booster water pump systems for garden hoses. More specifically the present invention relates to booster water pump systems having housings that support hose reels.

Typically, homes using municipal or well water are limited to water from a faucet or bibcock at a pressure of about 40-60 pounds per square inch (psi), flowing at a rate of about 3-5 gallons per minute (gpm). However, unassisted municipal or well water pressure and flow rate may be insufficient to effectively scrub surfaces, quickly water plants, or controllably spray distant cleaning targets. As such, booster pumps provide extra water pressure and flow for indoor or outdoor applications, such as gardening, cleaning, or other applications. Water pressure levels produced by booster pumps are low enough that conventional garden hoses may be used, but high enough to meet the requirements of various tasks.

Devices other than garden hose boosting pumps, such as powered pressure washers for example, are known to be used to clean dirt, paint, or mold from pavement, brick face, cement, or other surfaces. To achieve such results, these devices may generally provide a water stream with a high pressure (e.g., 1400 psi), but with reduced flow rate (e.g., 1.3-1.4 gpm). Heavy duty pressure washers may provide streams with even higher pressures (e.g., 3000-5000 psi) and possibly greater flow rates (e.g., 3.5 gpm). The high pressure streams of heavy duty pressure washers may facilitate more demanding tasks, such as resurfacing or cutting of materials, which may require extremely powerful flows. High-pressure hose lines and spray guns are used with heavy duty pressure washers.

SUMMARY

One embodiment of the invention relates to a booster pump system, for boosting a flow of water from a water source. The booster pump system includes a housing having a retractable handle. The booster pump system also includes a water pump positioned within the housing. The pump has an inlet and an outlet, and is designed to raise the pressure of the flow of water by an amount in a range of 20-200 pounds per square inch. The pump is also designed to raise the flow rate of the flow of water by an amount in a range of 0.5-5 gallons per minute. The booster pump system further includes a hose reel positioned within the housing, where the hose reel supports a garden hose attached to the outlet of the pump.

Another embodiment of the invention relates to a booster pump system for boosting a flow of water from a bibcock or faucet coupled to a water source. The booster pump system includes a housing having a cover and a storage area for storing accessories. The booster pump system also include a garden hose fitting attached to the housing. Further, the booster pump system includes a water pump positioned within the housing. The pump has an inlet attached to the fitting, and an outlet, and the pump is designed to raise the pressure of the flow of water by an amount in a range of 20-200 pounds per square inch. The pump is also designed to raise the flow rate of the flow of water by an amount in a range of 0.5-5 gallons per minute. The booster pump system additionally includes a hose reel positioned within the housing. The hose reel supports a hose attached to the outlet of the pump. Also, the hose reel is designed to support the hose when the hose is pressurized with the boosted flow of water flowing through the hose.

Yet another embodiment of the invention relates to a powered garden hose reel and booster pump system. The system includes a housing and a pump having an inlet and an outlet. The pump is powered by a first electric motor, and the pump is positioned within the housing. The system also includes a hose reel positioned above the pump within the housing. The hose reel supports a hose attached to the outlet of the pump. Also, the system includes a second electric motor for winding the hose onto the reel. The system further includes a moving guide to direct the winding of the hose onto the reel.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Some embodiments described herein relate to a booster pump system for a garden hose, as opposed to a pressure washer system. In certain scenarios a user may desire an increased flow rate and pressure beyond the capabilities of an unassisted garden hose, but not with the reduced flow rate and much higher pressures of a pressure washer. Such scenarios may include, for example, removing stuck-on plant debris from a vehicle, removing dried-on bird waste from a window, or removing spider webs from an eve of a high roof line, out of reach of a garden hose having unassisted pressure and flow. A booster pump system powers a water stream from a household water system with an increased flow rate and pressure suitable for everyday-type cleaning and gardening applications.

Figure 1A:
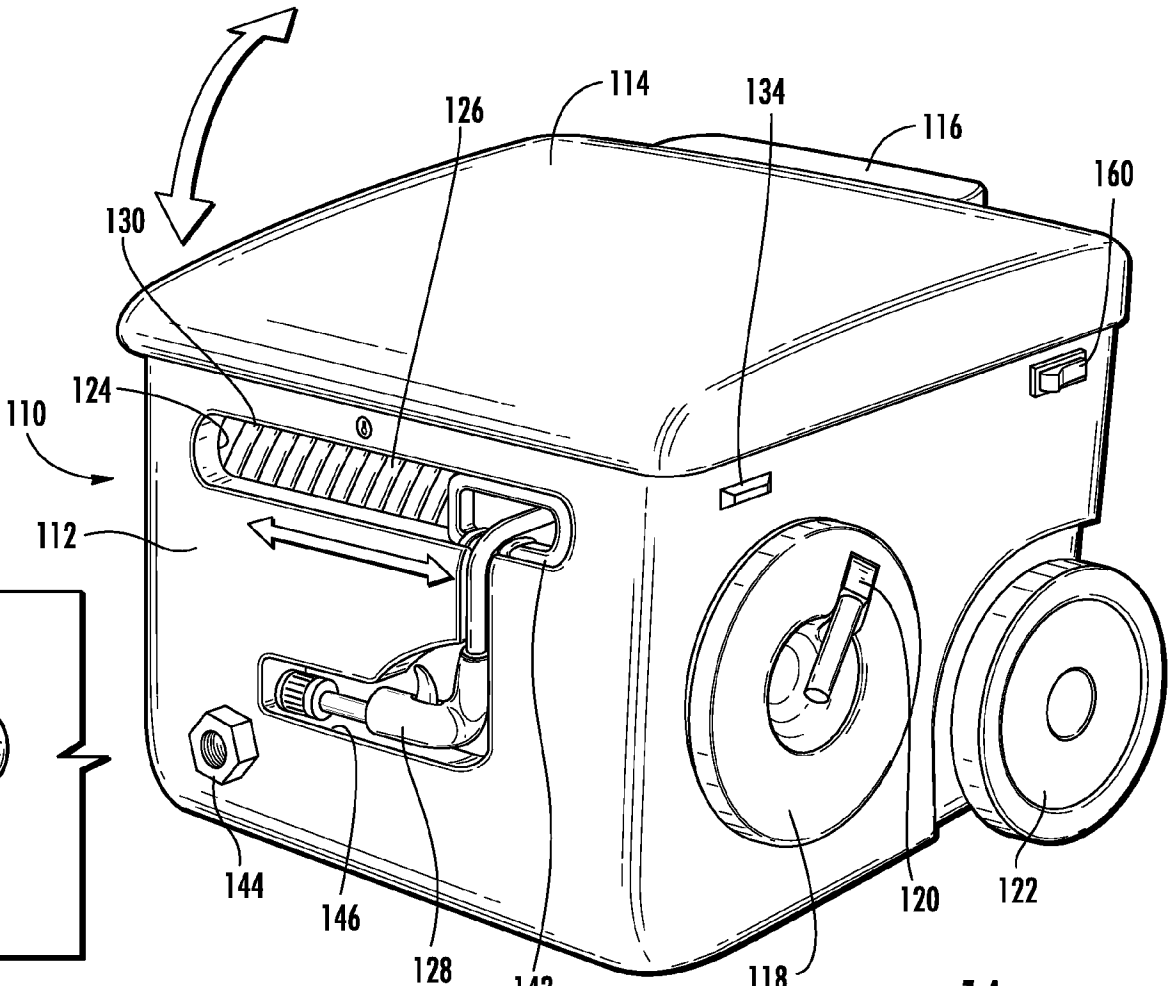
FIG. 1A is a perspective view of a booster pump system according to an exemplary embodiment.

Referring to FIG. 1A, a booster pump system 110 is shown, according to an exemplary embodiment, to include a housing 112 having a cover 114, a handle 116, and wheels 122. A user may tilt the system 110 over the wheels 122 with the handle 116, and then roll the system 110 to a desired place of use. Within the housing 112, the system 110 includes a hose reel 130 that is designed to support a garden hose 126 wound on the reel 130, while the hose 126 is pressurized due to water flowing through the hose 126. One end of the hose 126 is coupled to an outlet of a motorized water pump (see, e.g. pump 512 shown in FIG. 5, having an inlet 544 and an outlet 546). An inlet of the pump is designed to be coupled to water source, such as an outdoor bibcock or an indoor faucet. An on/off switch 160 permits or denies electricity to power the pump. In other embodiments, the on/off switch 160 activates an automatic starter of a small combustion engine powering the pump.

Still referring to FIG. 1A, the garden hose 126 may be wound with a manual rewind 118 that includes a handle 120. A user rotates the handle 120, which winds the garden hose 126 onto the reel 130 (see also FIG. 2) within the housing 112. A guide 142 positions the hose 126 along the reel in an orderly wind. Rotation of the handle 120 of the manual rewind 118 may directly or indirectly control the movement of the guide 142. In other embodiments, the reel may move back and forth, while the guide remains fixed.

Figure 5:
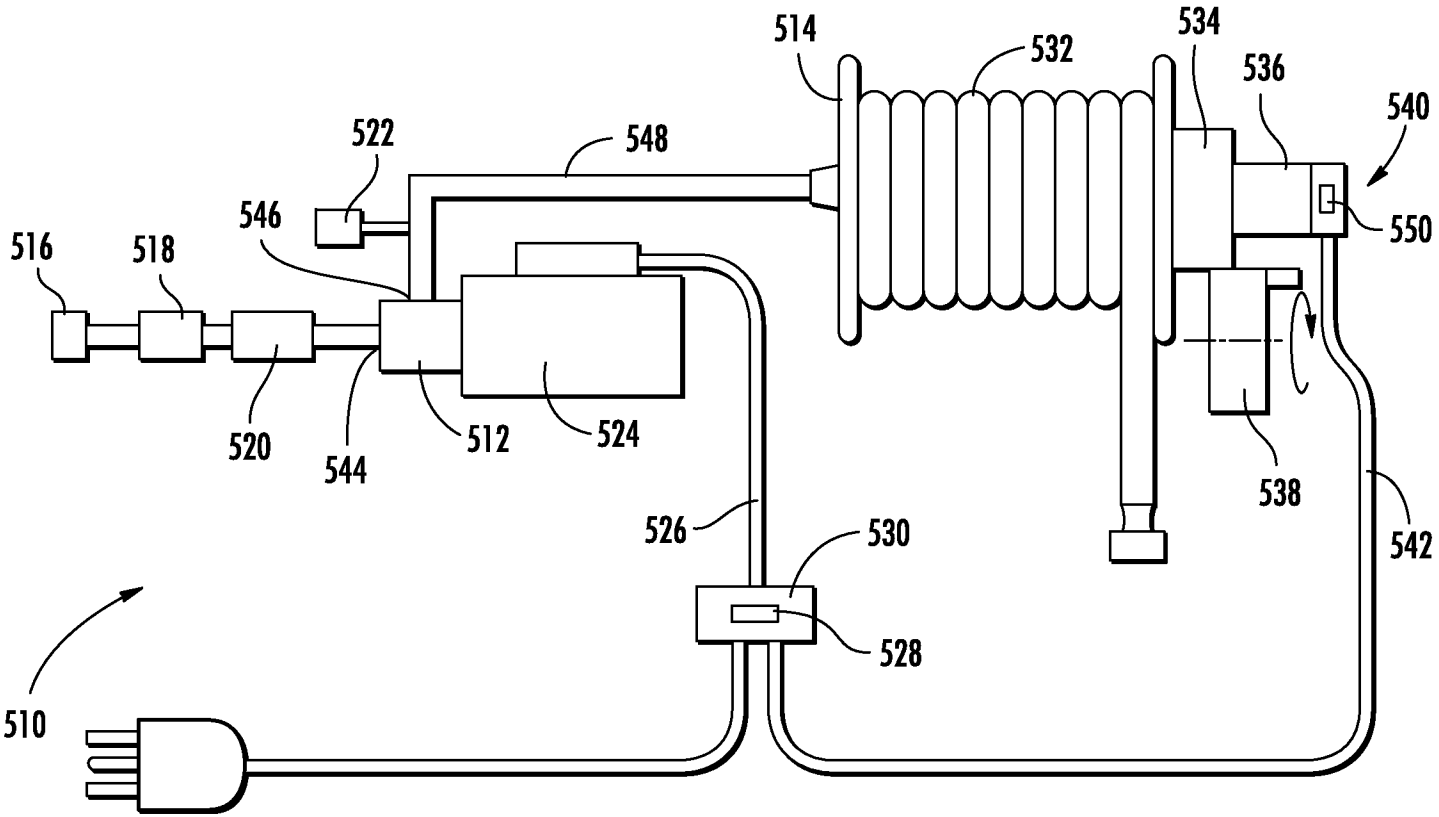
FIG. 5 is a schematic view of a booster pump system according to an exemplary embodiment.

In an exemplary embodiment, the system 110 also includes an automated rewind system (see, e.g., power rewind system 540 shown in FIG. 5). An on/off switch 134 for the automated rewind system is shown to extend from an exterior surface of the housing 112. In other embodiments, a garden hose reel and booster pump system includes an automated rewind system without an additional manual rewind. In some embodiments, the power rewind system 540 may be activated by a user pressing a foot pedal on an exterior of the housing 112, positioned near the base of the housing. In some embodiments, the automated rewind system is powered by a torsion spring that is loaded when a user pulls out the hose 126. In still other embodiments, water pressure is used to rotate the reel.

As shown in FIG. 1A, the housing 112 also includes an aperture 124 through which the garden hose 126 may be extracted. In some embodiments, a sliding cover seals the aperture 124, shielding components within the housing 112 from the outside environment. The sliding cover slides back and forth with the movement of the hose guide 142. Additionally, the housing 112 further includes access to a pump inlet fitting 144, such as a quick connect fitting or a threaded male or female hose fitting. A garden hose (not shown) may be used to link a household water source to the system 110 by coupling to the fitting 144.

Figure 1B:
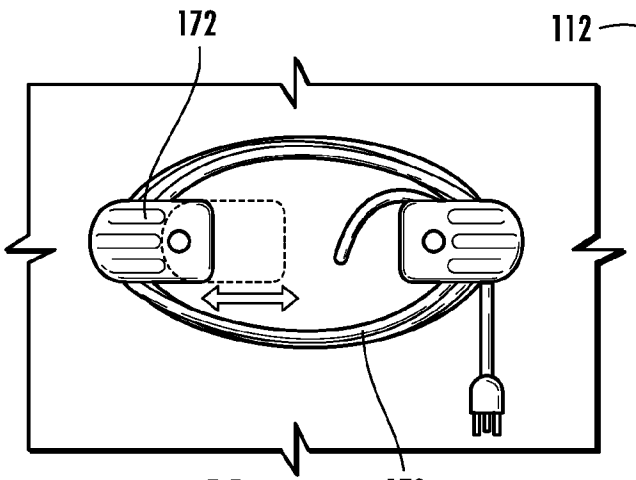
FIG. 1B is a front view of a power cord rack according to an exemplary embodiment.

Still referring to FIG. 1A, the garden hose 126 is fitted with a nozzle 128, spray gun, sprinkler, etc., which may be stored in a cavity 146 on an exterior surface of the housing 112. In some embodiments, the cavity 146 includes hooks, clips, or other fasteners with which the nozzle 128 may be held. In addition to the cavity 146 for the nozzle 128, the handle 116 and the manual rewind handle 120 may be stored in the housing 112. Storage of exterior components of the system 110 within the housing 112, such as the nozzle 128 and the handles 116, 120, reduces the drag profile of the system 110, which may help prevent tipping of the system 110 during periods of high winds. FIG. 1B shows a power cord 170 and a rack 172 for storing the power cord 170. In some embodiments, the rack 172 is located on an exterior side of the system 110, below the handle 116. In other embodiments, the rack 172 is positioned under a hood or cover that is fastened to an exterior side of the system 110.

Booster pump systems may be better suited to operate with typical garden hoses than pressure washers due to characteristics of the garden hoses, such as their burst ratings. The garden hose 126 may be made from a wide variety of commonly known materials such as vinyl, rubber, composite, and the like. For example, typical garden hose characteristics may vary depending design choice, such as hose dimensions, gauge, material, reinforcement, and the like. Some garden hoses are constructed of a synthetic rubber or soft plastic. These hoses are reinforced with internal or external fiber webbings, such as nylon or polyester tire-cords. Certain hoses are "reinforced vinyl" garden hoses. Due the variety of design choices and available materials, different commercial garden hoses have a broad range of "burst strengths" or "burst ratings," the maximum allowable internal pressures that a hose can withstand before rupture. Some lower-quality hoses, for use with embodiments disclosed herein, have a burst rating of about 200 psi. Other medium-quality hoses have burst ratings ranging from about 275 to 350 psi. Still other higher-quality garden hoses have burst ratings from about 350 to 500 psi or higher.

Figure 2:
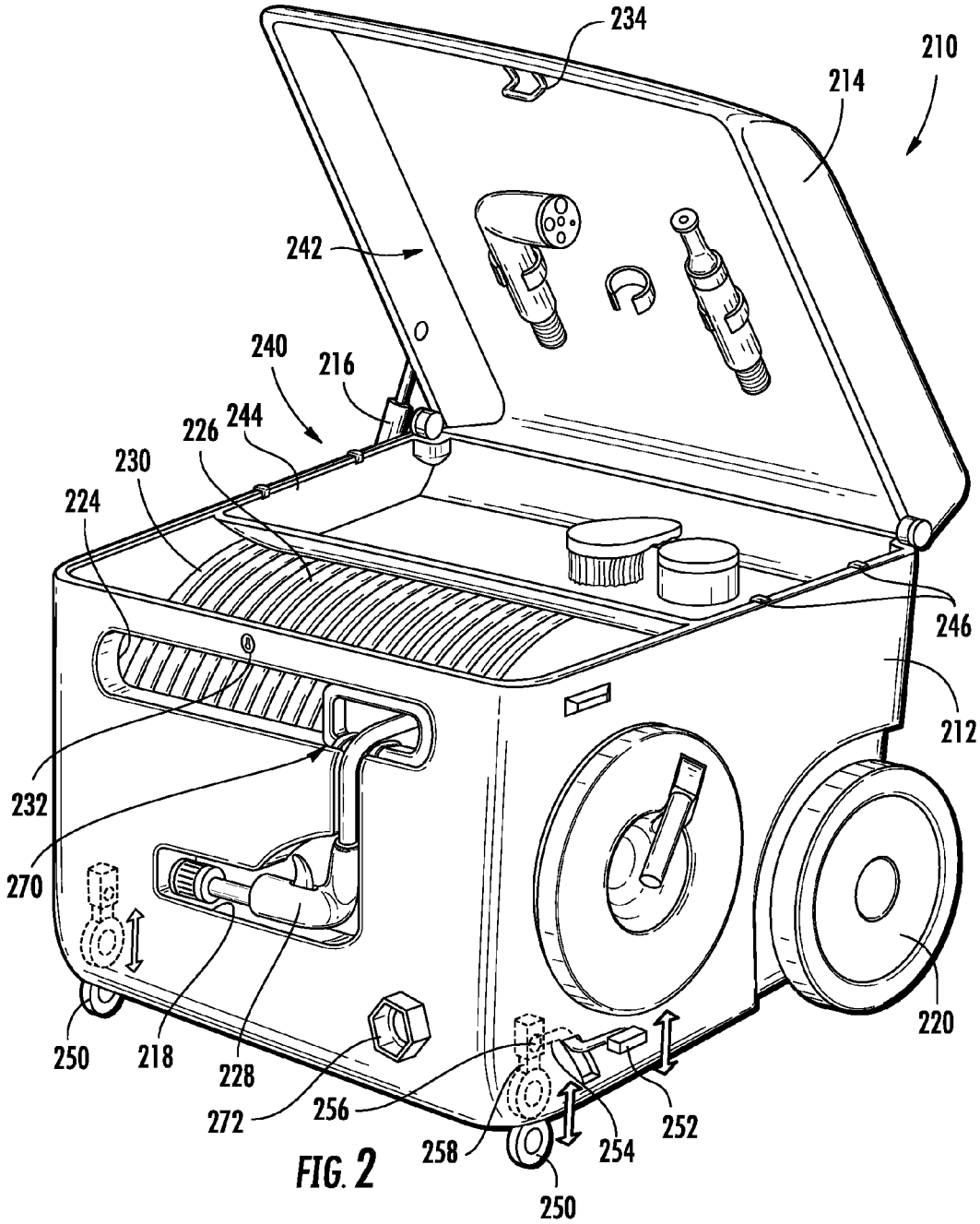
FIG. 2 is a perspective view of a booster pump system according to another exemplary embodiment.

Referring to FIG. 2, a garden hose reel and booster pump system 210 is shown having a housing 212 with a cover 214 in an opened position. A support 216 or brace is used to hold the cover 214 in the opened position, and may also include a shock absorber (i.e., damper) to prevent slamming of the cover 214. The housing 212 holds a hose 226 wrapped around a hose reel 230, with an end of the hose 226 extending through an aperture 224. A spray gun 228 is attached to the end of the hose 226. The spray gun 228 fits within a cavity 218 for storage on an exterior surface of the housing 212. FIG. 2 also shows a sliding reel guide 270 adjacent to the aperture. A female quick-connect garden hose coupler 272 on the outside surface of the housing 212 directs water to the pump inlet.

In addition to the cavity 218, storage areas 240, 242 are shown within the housing 212 and cover 214, respectively. The storage area 240 includes a removable tray 244. The tray 244 has hooks 246 that catch a top edge of the housing 212. The cover 214 closes over the hooks 246. Various items, including garden hose accessories, such as car wax, a scrub brush, an additional length of hose, and other items may be stored in the tray 244. The tray 244 may be lifted out of the housing 212 to access components below the tray 244. In other embodiments, a shelf may be fixed to the housing with glues, hinges, welds, threaded fasteners, or other fasteners. In still other embodiments, a sliding drawer slides into and out of the housing 212, and is accessible from an exterior surface of the housing 212. The storage area 242 includes clips attached to an underside surface of the cover 214. The clips are designed to hold garden hose accessories, such as spray guns, nozzles, and other items.

Still referring to FIG. 2, the system 210 includes back wheels 220 and retractable front wheels, in the form of casters 250 coupled to a foot pedal 252. A user may push the pedal 252 to engage the casters 250. For example, pushing down the foot pedal 252 lowers a lever arm 254, which rotates gearing 256 that engages teeth arranged vertically along a shaft 258 with one of the casters 250 on an end of the shaft 258. The foot pedal 252 can be locked into and released from the down position. When the casters 250 are down, the casters 250 and the wheels 220 support the housing such that the housing may be rolled to a desired location. In some embodiments, the casters 250 have treads designed to roll over grass or other terrain. In other embodiments, both front and back wheels are retractable. In still other embodiments, the wheels are always engaged (i.e., not retracted), and the wheels may be locked and unlocked to mobilize and immobilize the system 210. Other embodiments may use various commercially available systems for mobilizing and immobilizing wheels.

As shown in FIG. 2, the housing 212 further includes a lock 232. The lock 232 includes a latch that engages a loop 234 on the cover 214, where the lock 232 allows a user to limit access to the interior of the housing 212 by locking the cover 214. In some embodiments, a main power switch (e.g., switch 528 shown in FIG. 5) is positioned within the interior of the housing 212 so that an unauthorized user may be prevented from activating the main power switch if the cover 214 is locked. The lock 232 also helps to secure accessories stored within the housing 212. In other embodiments, other commercially available locking systems are used, such as padlocks, cylinder locks, locking latches, and other locking systems.

Figure 3A:
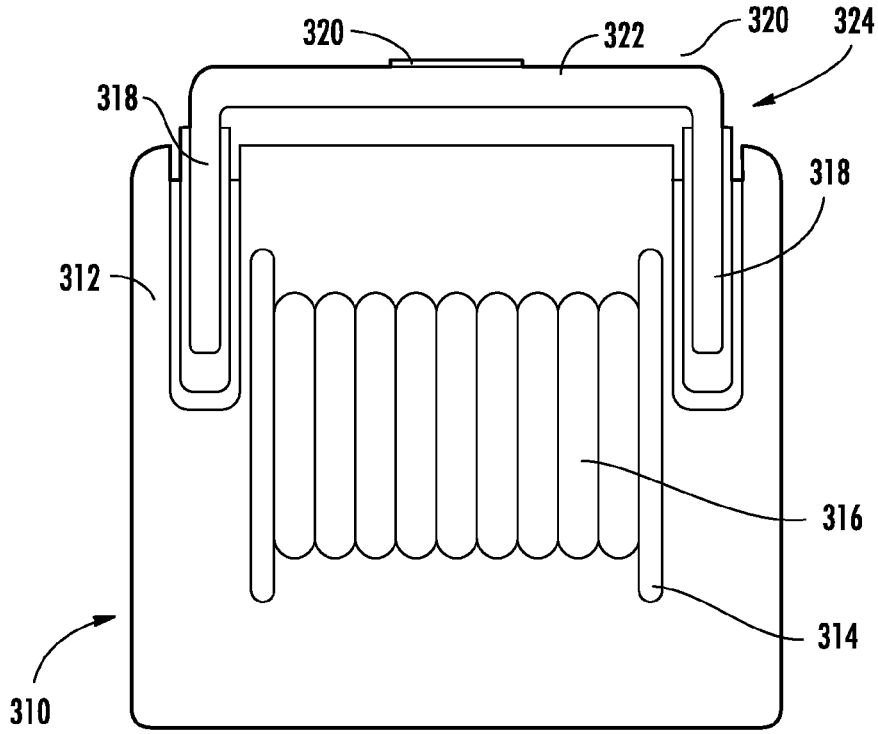
FIG. 3A is a sectional view of a booster pump system according to an exemplary embodiment.

FIG. 3A shows a top-down sectional view of a booster pump system 310 which includes a housing 312, a hose reel 314, and a hose 316 wrapped around the reel 314. Additionally, the system 310 includes a retractable handle 324 with telescoping extensions 318. A user may press a button 320 to release a catch so that the telescoping extensions 318 may slide relative to the housing 312. For example, to extend the handle 324 the user may press the button 320 and pull a cross bar 322 of the handle 324 away from the housing 312. When the handle 324 has extended from the housing 312 by a desired length, the user may then release the button 320 to re-engage the catch, locking the handle 324 in the extended position. The handle 324 may then, for example, provide leverage to tilt the system 310 or to roll the system 310 to a desired location. Following use of the handle 324, the user may then press the button 320 to release the catch, and slide the handle 324 back into the housing 312. In some embodiments, the angle from which the handle 324 is positioned relative to the housing 312 may be adjusted. In other embodiments, the handle includes only a single telescoping arm positioned near the center of the housing.

Figure 3B:
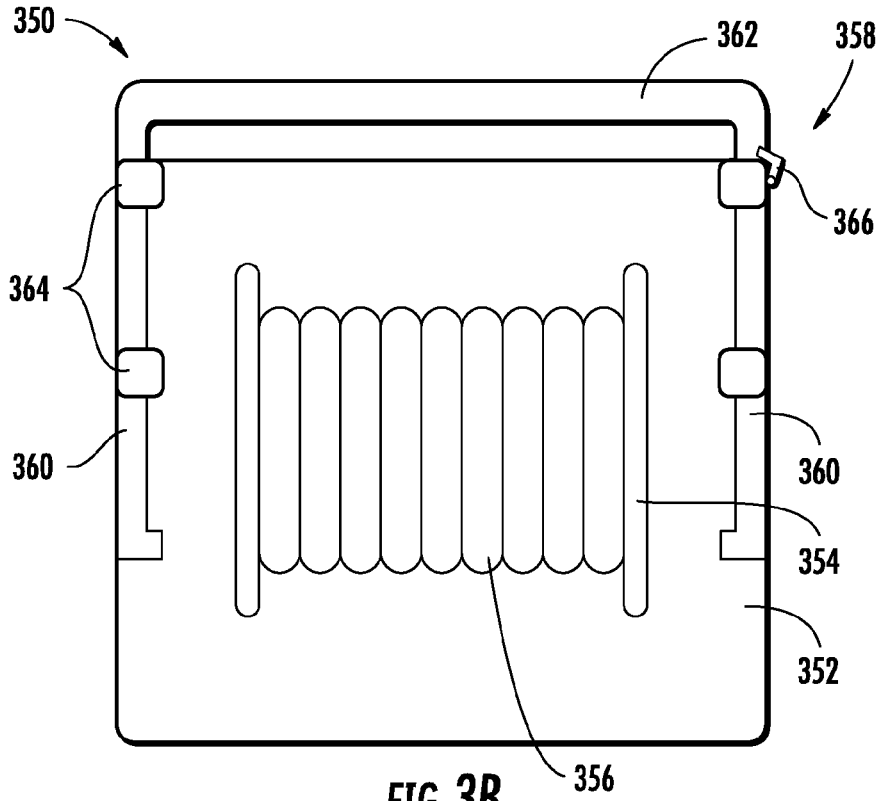
FIG. 3B is a sectional view of a booster pump system according to another exemplary embodiment.

FIG. 3B shows a top-down sectional view of a booster pump system 350, which includes a housing 352, a hose reel 354, and a garden hose 356 wrapped around the hose reel 354. Additionally, the system 350 includes a retractable handle 358 having arms 360 and a cross member 362. The arms 360 slide through guiding brackets 364 or sleeves. In some embodiments, the arms 360 ratchet and lock into an extended position. A user may then release a pawl 366 to slide the arms 360 back into the housing 352. Other embodiments use various commercially-available retractable handles.

Figure 4:
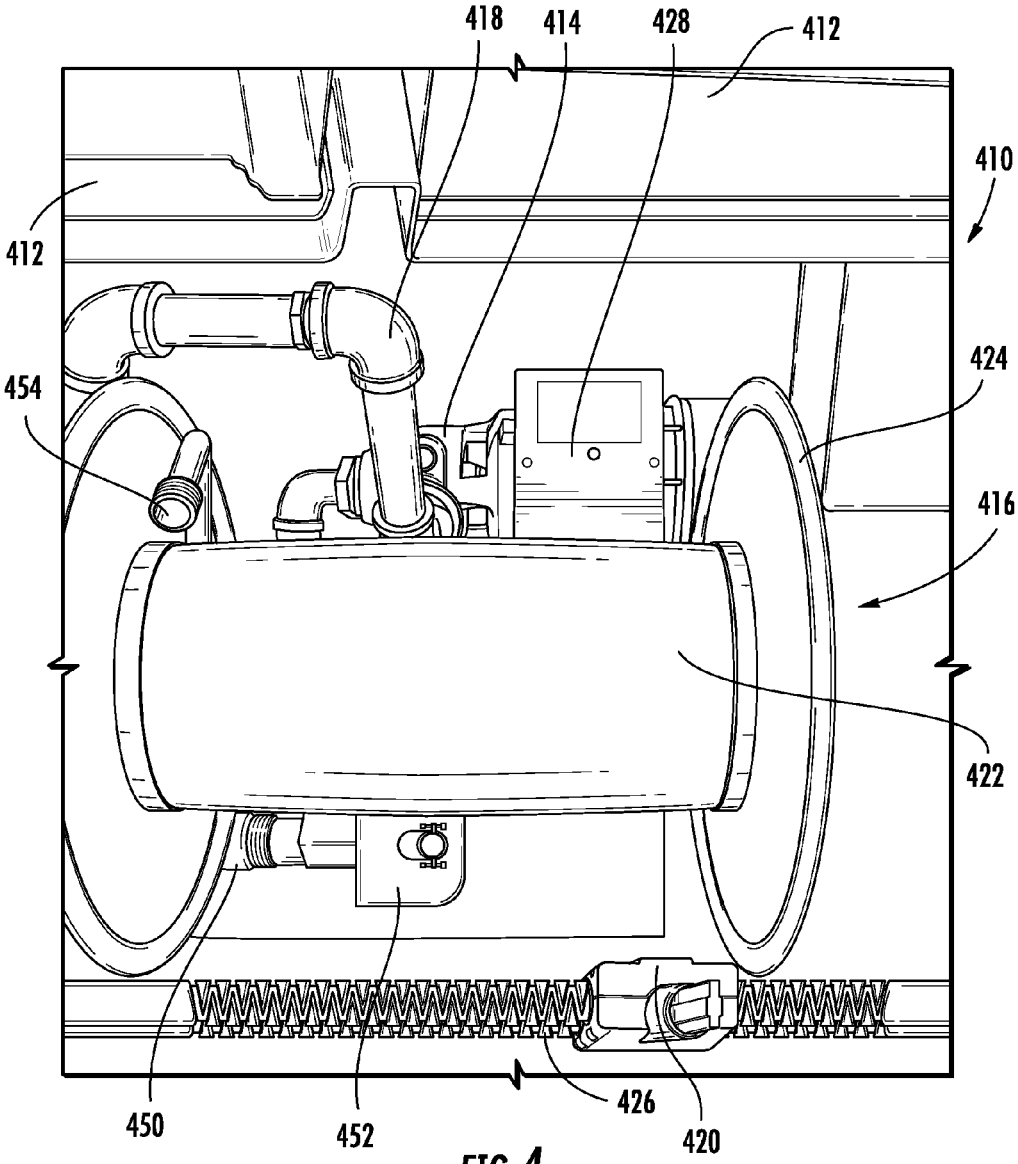
FIG. 4 is a perspective view of an interior of a housing for a booster pump system according to an exemplary embodiment.

Referring to FIG. 4, components of a booster pump system 410 are shown within a housing 412 in FIG. 4. The components include a water pump 414 with a motor 428, a hose reel 416, and a hose reel guide 420. The hose reel 416 is positioned above the pump 414 and motor 428. The weight of the pump 414 and motor 428, arranged proximate to the support base of the housing 412, help to prevent tipping of the system 410, such as in high winds, or when the hose reel 416 is winding the hose. Also shown in FIG. 4 are an inlet fitting 450 proximate to a flow switch 452 that is positioned along the inlet path to the pump 414.

The hose reel 416 includes a hub 422 or a drum upon which a hose may be wound. Flange ends 424 of the hose reel 416 form boundaries to the hub 422. The hose reel guide 420 moves back and forth along a track 426 as the hose reel 416 rotates. The hose is laid onto the reel 416 in an orderly manner, such as with side-by-side coils in overlaying rows, with a first row formed as the guide 420 moves in one direction, a second row formed as the guide 420 moves back, and so forth. The pump 414 has an outlet pipe 418 that 418 extends into the center of the hub 422 and includes a hose coupling 454 that rotates within the hub 422, allowing the outlet pipe 418 to remain stationary. The hose coupling 454 connects to a garden hose wound on the reel. The hose reel 416 is a "live" hose reel in that it is configured to support a pressurized hose. For example, the pump 414 may supply higher pressure and flow rate water while the hose is wound on the reel 416, without the hose unwinding from the reel 416. In some embodiments, ratcheting members, pawls, or gears limit rotation of the reel 416 reacting to torque in the reel 416.

Referring to FIG. 5, a booster pump system 510 includes a water pump 512 and a hose reel 514. The pump 512 includes an inlet 544 and an outlet 546, with the outlet 546 coupled to a pipe 548 that directs water to the hose reel 514.

In FIG. 5, components related to the water pump 512 include an inlet hose coupling 516 (see also fitting 144 as shown in FIG. 1A, fitting 272 as shown in FIG. 2), a flow-sensitive switch 518, a check valve 520, a pressure sensor 522 or a pressure-sensitive switch, and a motor 524. The motor 524 is an electric motor with a power cord 526. In other embodiments, the motor may be powered by batteries, or the motor may be a combustion engine powered by gasoline, diesel, or other fuels. The pump 512 is a centrifugal-type pump. In other embodiments, different types of pumps are used, including reciprocating pumps or positive displacement pumps. For example, at least one embodiment includes a pump that uses a piston-style positive displacement pump. Centrifugal pumps may be preferred over piston-style pumps because no bypass may be needed with centrifugal-type pumps for water to flow through the pump when power is not provided to the pump. In some embodiments the pump is electrically-powered and has a ground fault protection, a circuit breaker, or a fuse.

Referring to FIG. 5, the booster pump 512 may have a maximum pressure capacity (e.g., maximum settings) of less than 1000 psi, preferably less than 500 psi; and a water flow rate capacity of at least 4 gpm, preferably at least 5 gpm. In another embodiment, the booster pump 512 is designed to raise water pressure by 20-200 psi, preferably between 50-100 psi; and to raise water flow rate by 0.5-5 gpm, preferably between 1-3 gpm. In at least one embodiment, the booster pump 512 is designed to raise water pressure by about 80 psi and raise flow rate by about 2 gpm.

In some embodiments, a sprayer, nozzle, sprinkler, or other outlet (e.g., spray nozzle 128 in FIG. 1A) includes calibrated spray settings having different cross-sectional areas. In at least one embodiment, a sprayer has a first setting with a narrower opening than a second setting, and the sprayer can be adjusted such that either the first or the second setting may be used. At a constant back pressure, the first setting allows for a lower flow rate of water through the sprayer than the second setting.

Still referring to FIG. 5, according to an exemplary embodiment, the flow-sensitive switch 518 measures, detects, or monitors characteristics of water flow (e.g., flow rate) into the pump 512. In at least one embodiment, the flow-sensitive switch 518 is configured to measure water flow rate relative to a threshold flow rate. When the water flow rate exceeds the threshold flow rate, the flow-sensitive switch 518 is closed (i.e., "on"), and when flow is below the threshold flow rate the flow-sensitive switch 518 is open (i.e., "off"). Opening the flow-sensitive switch 518 cuts power to the pump 512, disengaging the pump 512. In some embodiments, the threshold rate corresponds to calibrated settings on the sprayer, where the second setting generates a water flow rate above the threshold flow rate, closing the flow-sensitive switch 518 and activating the pump 512. The first setting reduces the water flow rate below the threshold flow rate, opening the flow-sensitive switch and deactivating the pump. Exemplary threshold flow rate values range from 1-5 gpm, preferably from 2.5-3.5 gpm. In some embodiments, the threshold can be manually adjusted. According to other embodiments, different commercially available gauges, sensors, meters, etc. may be provided to sense characteristics of the water flow.

The system 510 further comprises the pressure sensor 522, which detects pressure changes through the system 510. In some embodiments, the pressure sensor 522 quickly distinguishes between a no-flow condition and a positive-flow condition by measuring back pressure. In some embodiments, the pressure sensor 522 is coupled to the switch 528, and power is cut to the motor 524 of the pump 512 when the pressure sensor 522 senses that the sprayer, nozzle, sprinkler, etc. has stopped spraying. In some embodiments, the system includes a pressure sensor, but no flow-sensitive sensor. In other embodiments, the system includes a flow-sensitive sensor, but no pressure sensor.

In FIG. 5, components related to the hose reel 514 include a garden hose 532, a transmission 534, a motor 536, a power switch 550, the hose reel guide 420 (see FIG. 4), and a manual rewind 538 (see also the manual rewind 118 in FIG. 1A). The transmission 534, the motor 536, and the power switch 550 correspond to a power rewind system 540. Activation of the power rewind system 540 both winds the hose 532 and lays the hose 532 on the reel 514 in an ordered manner. Rotational power from the motor 536 or the manual rewind 538 is transferred through the transmission 534 to the hose reel 514. Some embodiments include parallel or planetary gearing reductions. According to an exemplary embodiment, a 100-foot garden hose may be wound on the hose reel 416. In some embodiments the motor 536 is an electric motor, powered through an electric cord 542 or with a battery.

The power cord 526 includes a manually-operated on/off switch 528 and a junction 530 (e.g., splitter). The on/off switch 528 may be provided in series with the flow-sensitive switch 518, such that if the on/off switch 528 is in the off position, the pump 512 will not be activated; but if the on/off switch 528 is in the on position, then the pump 512 may be activated by the flow-sensitive switch 518 or its analog. In another embodiment, the on/off switch 528 is provided in parallel with the flow-sensitive switch 518, such that the on/off switch 528 may override the flow-sensitive switch 518, activating or deactivating the pump 512 regardless flow rate.

The construction and arrangements of the garden hose booster water pump system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A booster pump system for boosting a flow of water from a water source, comprising: a water pump positioned within a housing, the pump having an inlet and an outlet, wherein the pump is configured to raise the pressure of the flow of water by an amount in a range of 20-200 pounds per square inch, and wherein the pump is configured to raise the flow rate of the flow of water by an amount in a range of 0.5-5 gallons per minute; a flow sensitive switch configured to activate the water pump when the flow rate of the flow of water exceeds a threshold flow rate; a garden hose coupled to the outlet of the pump; and a pressure sensitive switch configured to detect the pressure at the outlet of the pump; wherein at a pressure indicating a no-flow condition through the garden hose, the pressure sensitive switch deactivates the water pump; whereby the flow sensitive switch does not deactivate the water pump upon the no-flow condition.

2. The system of claim 1, wherein the housing includes a retractable handle.

3. The system of claim 2, wherein the retractable handle slides from the housing to an extended position and releasably locks into the extended position.

4. The system of claim 3, further comprising wheels coupled to a base of the housing, whereby the system may be rolled to a desired location of operation.

5. The system of claim 4, wherein the wheels are retractable.

6. The system of claim 5, further comprising a foot lever to extend the wheels.

7. The system of claim 6, wherein the wheels comprise at least two casters, and wherein the casters are configured to retract into the housing and extend from the housing.

8. A booster pump system for boosting a flow of water from a water source, the system comprising: a housing comprising a cover and a storage area for storing accessories; a garden hose fitting coupled to the housing; a water pump positioned within the housing, the pump having an inlet coupled to the garden hose fitting, and an outlet, wherein the pump is configured to raise the pressure of the flow of water by an amount in a range of 20-200 pounds per square inch, and wherein the pump is configured to raise the flow rate of the flow of water by an amount in a range of 0.5-5 gallons per minute; a flow sensor that detects the flow rate of the flow of water; a flow switch that activates the water pump when the flow rate of the flow of water is greater than a threshold flow rate; a hose coupled to the outlet of the pump; and a pressure sensitive switch configured to detect the pressure at the outlet of the pump; wherein at a pressure indicating a no-flow condition through the hose, the pressure sensitive switch deactivates the water pump; whereby the flow switch does not deactivate the water pump upon the no-flow condition.

9. The system of claim 8, wherein the storage area comprises a removable tray.

10. The system of claim 8, wherein the cover is hinged, and the system further comprises a releasable lock configured to hold the cover to the housing in a locked position.

11. The system of claim 10, wherein the storage area comprises a cavity on an exterior surface of the housing, and wherein the cavity is sized to store at least one of a sprinkler, a nozzle, or a spray gun.

12. The system of claim 11, further comprising a motor for winding the hose on a reel and a guide to direct the winding of the hose onto the reel, wherein the motor, the reel, and the guide are positioned within the housing.

13. The system of claim 12, further comprising a retractable handle and retractable wheels, wherein the handle and the wheels retract into the housing.

14. The system of claim 1, wherein the threshold flow rate is 2.5 gpm.

15. The system of claim 8, wherein the water pump is located in the housing below a hose reel.

16. The system of claim 1, further comprising:

a sprayer coupled to the garden hose, the sprayer having a first spray setting associated with a first flow rate through the sprayer and a second spray setting associated with a second flow rate through the sprayer, the second flow rate greater than the first flow rate, the second flow rate greater than the threshold flow rate, the first flow rate and the second flow rate both greater than zero, and the second spray setting having a larger opening for water flow than the first spray setting.

17. The system of claim 8, further comprising:

a sprayer having a first spray setting associated with a first flow rate through the sprayer and a second spray setting associated with a second flow rate through the sprayer, the second flow rate greater than the first flow rate, the second flow rate greater than the threshold flow rate, the first flow rate and the second flow rate both greater than zero, the second spray setting having a larger opening for water flow than the first spray setting, the sprayer coupled to the hose.

18. The system of claim 1, further comprising:

a hose reel positioned within the housing, wherein the hose reel supports the garden hose.

19. The system of claim 8, further comprising:

a hose reel positioned within the housing, wherein the hose reel supports the hose, and wherein the hose reel is configured to support the hose when the hose is pressurized with the boosted flow of water flowing therethrough.

* * * * *